US005186724A

United States Patent [19]

Sartor

[11] Patent Number: 5,186,724

[45] Date of Patent: Feb. 16, 1993

[54] SHAPED BODIES FOR DRILLING OR CUTTING HARD MATERIALS

[75] Inventor: Dietmar Sartor, Fürstentum, Liechtenstein

[73] Assignee: Hilti Aktiengesellschaft, Furstentum, Liechtenstein

[21] Appl. No.: 776,813

[22] Filed: Oct. 15, 1991

[30] Foreign Application Priority Data

Oct. 19, 1990 [DE] Fed. Rep. of Germany ..... 4033214

[51] Int. Cl.[5] ..... B24D 3/00

[52] U.S. Cl. ..... 51/293; 51/309

[58] Field of Search ..... 501/293, 309

[56] References Cited

U.S. PATENT DOCUMENTS

| | | | |
|---|---|---|---|
| 3,496,682 | 2/1970 | Quaas et al. | 51/293 |
| 4,496,372 | 1/1985 | Almond et al. | 51/309 |
| 4,655,795 | 4/1987 | Bleecker et al. | 51/309 |
| 4,923,490 | 5/1990 | Johnson et al. | 51/309 |
| 4,968,326 | 11/1990 | Wiand | 51/309 |

OTHER PUBLICATIONS

Heubner & Wasserman, *Science of Metal,* 1962 pp. 152–161.

Reinback, *Material Handbook of Non-Ferrous Metals,* 1960, pp. 1–14.

Zwickler, *Science of Metals,* 1962, pp. 709–714.

*Primary Examiner*—Mark L. Bell

*Assistant Examiner*—Deborah Jones

*Attorney, Agent, or Firm*—Anderson Kill Olick & Oshinsky

[57] ABSTRACT

Shaped bodies for use in drilling or cutting hard materials, such as rock, concrete and masonry, are formed of a matrix material with embedded abrasive particles. The matrix material is based on a copper alloy precipitated in the range of 200° to 600° C., for a selected period of time in accordance with the intended use of the shaped body. Accordingly, a shaped body is produced using a single matrix material and having the required characteristics for a specific use.

6 Claims, No Drawings

SHAPED BODIES FOR DRILLING OR CUTTING HARD MATERIALS

BACKGROUND OF THE INVENTION

Tools are used for vibration-free drilling or cutting in natural stone, such as rock formations, or in hard construction materials, such as concrete or brick. Such tools have cutting surfaces or edges formed by a hard material, such as carbides, nitrides, carbide-nitride-mixed phases, diamonds and similar substances. Substances such as natural, synthetic or polycrystalline diamond, $B_4C$, SiC, TiC, BN, TiN, $Al_2O_3$, $Zro_2$, and other cutting substances are frequently used as the hard material. Diamonds or a cutting material alloy are mostly used for concrete and hard stone working, while for softer structural materials, SiC, $Al_2O_3$ and the like are often used. Fine abrasive particles of these materials are embedded in a matrix. These matrices, containing abrasive particles, are designated as cutting or drilling shaped members in the following independently of whether or not they are arranged on a carrier member such as a drilling shank, disks or the like. The cutting or drilling members can have different shapes depending on the manner in which they are used, for instance, they may be hollow drilling crowns, rings, pins, plates, sections, as well as other simple or complex shaped bodies. A cutting disk may have a segment, ring, or disk shape, while a drilling member may have a cutting head, plate cylinders or the like.

The matrix material along with the abrasive particles or parts embedded in them are subject to wear, and the rate of wear depends on the type of working operation being carried out, that is, the hardness of the material to be cut or drilled. To adapt a drilling bit and particularly the cutting or drilling member to the requirement of different uses, a plurality of different matrix materials would be required. In practice, such a provision is undesirable for evident obvious reasons and can hardly be realized. The search for a universally usably matrix material has, up to the present time, been unsuccessful, especially when costs are taken into consideration.

SUMMARY OF THE INVENTION

Surprisingly, a solution has been found for the problem with a matrix material of uniform substantive composition.

Therefore, the present invention provides copper alloys hardenable by precipitation to different hardnesses and strengths as matrices for shaped bodies containing abrasive particles for use as drilling or cutting elements.

The particular advantage of the present invention is that the matrix material containing the abrasive particles and with the required hardness can be produced with use of only a single copper alloy by the manufacturer and possibly also the user, by employing a heat treatment namely isothermal aging, that is, precipitation, adapted to the specific use of the shaped body. Accordingly, a drilling or boring member can be fabricated meeting the respective use requirement by employing a single matrix composition. The shaped body can be of the types described above.

The adjustment to different hardnesses and strengths in copper alloys by precipitation is known (Heubner and Wassermann, Science of Metal; 1962, 152; Material Handbook Non-Ferrous Metals, VDI Publisher; Low Alloyd Copper Alloys, German Copper Institute; Non-Ferrous Metals and Alloys, V. Sedlacek, Elsevier Publisher; U. Zwickler, Science of Metals, 1962, page 709, Investigation about Separation Behavior of Supersaturated Copper Titanium Mixed Crystals). For the present use, copper alloys such as copper-beryllium alloys with approximately 1 to 2% by weight Be, also with small amounts of cobalt, for instance $CuBe_2$, $CuBe_2Co$, copper titanium alloys with approximately 1 to 6% by weight of titanium, for instance, $CuTi_4$, copper chrome alloys with up to 1% by weight of Cr, also with amounts of zirconium, for instance, CuCr, CuCrZr, copper-nickel-silicon alloys with approximately 1 to 5% by weight Ni and up to 1.5% by weight of silicon, for instance, $CuNi_3Si$, $CuNi_3Si_1$, copper-manganese-nickel alloys with approximately 20% by weight of Mn and 20% by weight of Ni, for instance $CuMn_2ONi_2O$ and the like are preferred for use in the present invention.

Temperatures in the range of 200° to 600° C., especially 300° to 500° C. are preferred for the precipitation, that is, the isothermal aging. The duration of the treatment is generally in the range of 5 to 120 minutes, however, it may be longer.

Embedding the abrasive particles, as mentioned above, or mixtures thereof takes place in a known manner. Such embedding can be effected by sintering, hot pressing (pressure sintering) or by another suitable process. While diamond is the preferred embedded abrasive particle, other hard materials could also be used.

Abrasive materials, namely matrices containing embedded diamonds, also cutting and severing elements, as well as tool bits equipped with cutting and severing elements, can be fabricated according to one of the previously known processes and are also subject of the present invention.

The hardened matrix materials can have a hardness in the range of approximately 100 HV hardness up to approximately 355 HV hardness or possibly higher.

The following examples serve to explain the invention:

EXAMPLE 1

Sequence of Operations

Hot Pressing

1. Mixing of powder: Matrix material $CuTi_4$-powder with diamond as the abrasive material.
2. Pressure Sintering
   Pressure: approximately 200–300 bar
   Temperature: approximately 750° to 850° C.
3. Precipitation Hardening
   Solution heating: approximately 700°–1000° C., approximately 10 to 60 min.
   This step can be accomplished by pressure sintering.
   Precipitation: Depending upon the material of the matrix, the temperature-time sequence must be selected as approximately 200°–600° C./5–120 min.

$CuTi_4$:
Variant 1: 550° C., 10 min.→300 HV
Variant 2: 360° C., 10 min.→200 HV

EXAMPLE 2

Sequence of Operations

Conventional Sintering Technology

1. Mixing of Powder: Matrix material $CuTi_4$-powder with diamonds as the abrasive material and an friction agent additive (pressing aid)
2. Cold Pressings:

filling of the mold pressing (approximately 4–7 t/cm$^2$)

exposure of the green compact member

3. Sintering: In a vacuum or controlled atmosphere furnace in the range of 800° to 1200° C.

4. Precipitation Hardening:

Solution heating: in the range of 700° to 1000° C., for approximately 10 to 60 min. This process can be performed simultaneously with the sintering process.

Precipitation: The temperature/time sequence must be selected depending on the matrix material;

$CuTi_4$:

Variant 1: 550° C., 10 min.→300 HV

Variant 2: 360° C., 10 min.→200 HV (The data are taken from literature)

While specific embodiments of the invention have been shown and described in detail to illustrate the application of the inventive principles, it will be understood that the invention may be embodied otherwise without departing from such principles.

I claim:

1. Method of making shaped bodies for use in drilling or cutting hard materials comprising the steps of mixing abrasive material in a matrix of a precipitation or age hardenable copper alloy, forming the mixture into a shaped body, heat treating the shaped body by precipitation or age hardening in a temperature range of 200° to 600° C. in accordance with the specific use of the shaped body.

2. Method, as set forth in claim 1, selecting the copper alloy from one of the group consisting of Cu-Ti with 1 to 6% by weight titanium, Cu-Be with 1 to 2% by weight of Be, Cu-Be with 1 to 2% by weight of Be and slight amounts of cobalt, Cu-Cr with up to 1% by weight of Cr, Cu-Cr with up to 1% by weight of Cr and an amount of zirconium, Cu-Ni-Si with 1 to 5% by weight of Ni and up to 1.5% by weight of Si and Cu-Mn-Ni with approximately 20% by weight of Mn and 20% by weight of Ni.

3. Method, as set forth in claim 1 or 2, carrying out the precipitation in a time range of 5 to 120 minutes.

4. A shaped body for use in drilling or cutting hard materials wherein the improvement comprises a drilling or cutting surface formed of a copper alloy matrix containing abrasive particles where the matrix is hardened by precipitation or age hardening at a temperature and for a period of time in accordance with the intended use of the shaped body.

5. A shaped body, as set forth in claim 4, wherein the copper alloy is selected from one of the group consisting of Cu-Ti with 1 to 6% by weight titanium, Cu-Be with 1 to 2% by weight of Be, Cu-Be with 1 to 2% by weight of Be and slight amounts of cobalt, Cu-Cr with up to 1% by weight of Cr, Cu-Cr with up to 1% by weight of Cr and an amount of zirconium, Cu-Ni-Si with 1 to 5% by weight of Ni and up to 1.5% by weight of Si and Cu-Mn-Ni with approximately 20% by weight of Mn and 20% by weight of Ni.

6. A shaped body, as set forth in claim 5, wherein the abrasive particles are diamonds.

* * * * *